US008936434B2

(12) United States Patent
Peterson et al.

(10) Patent No.: US 8,936,434 B2
(45) Date of Patent: Jan. 20, 2015

(54) PORTABLE IN-LINE FLUID BLOWER

(75) Inventors: Brent Peterson, Buffalo Grove, IL (US); Feng Wang, Vernon Hills, IL (US)

(73) Assignee: Echo, Inc., Lake Zurich, IL (US)

( * ) Notice: Subject to any disclaimer, the term of this patent is extended or adjusted under 35 U.S.C. 154(b) by 821 days.

(21) Appl. No.: 13/022,690

(22) Filed: Feb. 8, 2011

(65) Prior Publication Data

US 2012/0201668 A1 Aug. 9, 2012

(51) Int. Cl.
*F04D 25/08* (2006.01)

(52) U.S. Cl.
CPC ..... *F04D 25/084* (2013.01)
USPC ..... 415/218.1

(58) Field of Classification Search
CPC ..... F04D 25/084; F04D 25/08; F04D 25/02
USPC ..... 415/121.3, 218.1, 219.1
See application file for complete search history.

(56) References Cited

U.S. PATENT DOCUMENTS

| | | | | |
|---|---|---|---|---|
| 2,586,145 | A | | 2/1952 | Breuer et at |
| 2,969,559 | A | | 1/1961 | Landis |
| 2,972,160 | A | | 2/1961 | Hahn |
| 3,937,590 | A | | 2/1976 | Mani |
| 4,132,507 | A | | 1/1979 | Akiyama et al. |
| 4,187,577 | A | | 2/1980 | Hansen et al. |
| 4,237,576 | A | | 12/1980 | Stakes |
| 4,286,675 | A | | 9/1981 | Tuggle |
| 4,404,706 | A | | 9/1983 | Loyd |
| 4,413,371 | A | | 11/1983 | Tuggle et al. |
| 4,461,055 | A | | 7/1984 | Zerrer et al. |
| 4,683,370 | A | | 7/1987 | Petersen et al. |
| 4,692,091 | A | | 9/1987 | Ritenour |
| 4,734,017 | A | | 3/1988 | Levin |
| 4,748,712 | A | | 6/1988 | DiGiovanni |
| 4,884,314 | A | | 12/1989 | Miner et al. |
| 4,945,604 | A | | 8/1990 | Miner et al. |
| 5,074,006 | A | | 12/1991 | Eremita |
| 5,090,088 | A | | 2/1992 | Toth |
| 5,251,281 | A | | 10/1993 | Fravel, Jr. |
| 5,511,281 | A | | 4/1996 | Webster |
| 5,695,318 | A | * | 12/1997 | Harmsen ..... 415/218.1 |
| 5,722,111 | A | | 3/1998 | Sowell et al. |
| 5,727,283 | A | | 3/1998 | Webster |
| 5,768,749 | A | | 6/1998 | Ohi et al. |
| 5,809,653 | A | | 9/1998 | Everts |
| 5,810,093 | A | | 9/1998 | Howard |
| 5,839,205 | A | | 11/1998 | Hung |
| 5,894,630 | A | | 4/1999 | Bitner et al. |
| 6,105,206 | A | * | 8/2000 | Tokumaru et al. ..... 15/344 |
| 6,367,162 | B2 | | 4/2002 | Fukumoto et al. |

(Continued)

*Primary Examiner* — Edward Look
*Assistant Examiner* — Jeffrey A Brownson
(74) *Attorney, Agent, or Firm* — Wood, Phillips, Katz, Clark & Mortimer

(57) ABSTRACT

A portable fluid blower with a housing having a central axis and defining a fluid flow path extending axially between an upstream inlet and a downstream outlet. A fan assembly has a rotary component that is operable to draw fluid into a first stage of the flow path and accelerate fluid incoming at the inlet radially outwardly to against a first housing surface portion that diverts the fluid to a second stage of the flow path. The second flow path stage is defined by facing second and third housing surface portions that cause the fluid to flow substantially fully axially in an annular space extending around the central axis between the first stage and a third stage. The fluid flows from the third stage to and through the downstream outlet.

25 Claims, 5 Drawing Sheets

(56) References Cited

U.S. PATENT DOCUMENTS

| | | | | |
|---|---|---|---|---|
| 6,460,272 | B2 | 10/2002 | Cheng | |
| 6,551,060 | B2 | 4/2003 | Mordue et al. | |
| 6,738,564 | B1 | 5/2004 | Tung | |
| 6,862,871 | B2 | 3/2005 | Morabit et al. | |
| 7,047,592 | B2 | 5/2006 | Sing et al. | |
| 7,048,499 | B2 * | 5/2006 | Mathson et al. | 415/119 |
| 7,382,104 | B2 | 6/2008 | Jacobson et al. | |
| 7,739,773 | B2 | 6/2010 | Schliemann et al. | |
| 7,739,800 | B2 | 6/2010 | Hurley et al. | |
| 7,896,612 | B2 | 3/2011 | Schliemann et al. | |
| 2006/0010850 | A1 | 1/2006 | Jacobson et al. | |
| 2008/0038073 | A1 | 2/2008 | Paolicelli | |
| 2011/0038724 | A1 * | 2/2011 | Decker et al. | 415/208.2 |

* cited by examiner

PORTABLE IN-LINE FLUID BLOWER

BACKGROUND OF THE INVENTION

1. Field of the Invention

This invention relates to fluid blowers and, more particularly, to a portable blower that can be mounted in-line on a support therefor.

2. Background Art

Portable blowers have been used for decades, and extensively in the landscaping industry. Such blowers are made portable and light in weight to allow them to be easily transported and operated by a user.

In one form, the components that generate the pressurized fluid are incorporated into a frame that is mounted on a user as a "backpack". The user controls the direction of discharged fluid by manipulating a flexible conduit and controllably positioning a nozzle at the end thereof from which the fluid is discharged under pressure.

A second type of portable blower is one wherein there is a fixed relationship between the components that generate the pressurized fluid and discharge outlet. This type of blower has two different designs. One design is held and repositioned through a handle on a housing formed around components that generate the pressurized fluid. The other design integrates the fluid pressurizing components in-line with a support that is held and repositioned through components on the support separate and spaced from the mechanism that generates the pressurized fluid.

The latter, in-line construction has a number of advantages. First of all, the in-line configuration allows incorporation of the blower unit into a support upon which different operating components might be interchangeably mounted to perform different tasks. For example, a universal-type support can be used to incorporate, in place of the blower, a line trimmer head, cutting blades, etc.

The in-line configuration also potentially allows an extended reach with the blower outlet, made possible by the use of a relatively long support. By incorporating straps, handles, etc. strategically into the design, configurations may be arrived at that do not put a significant strain on a user while facilitating reorientation during use.

However, inherently the in-line design requires an enlarged housing to generate adequate fluid flow volume and velocity. Designers of this type of equipment thus contend with the competing objectives of producing designs that are compact and lightweight while at the same time capable of generating the demanded volume and velocity of air flow at the discharge location.

Still further, those designing in-line blower units must be cognizant of meeting the above objectives while maintaining the cost of such units in a reasonable price range. One potential advantage of having interchangeable units on a common support is that a single power supply might be used to selectively operate different components. If the price of the in-line blower unit becomes too high, users may opt to purchase a separate, dedicated fluid blower unit.

The industry continues to seek out better in-line fluid blower designs.

SUMMARY OF THE INVENTION

In one form, the invention is directed to a portable fluid blower with a housing having a central axis and defining a fluid flow path that extends axially between an upstream inlet and a downstream outlet. A fan assembly has a rotary component that is operable to draw fluid into a first stage of the flow path and accelerate fluid incoming at the inlet radially outwardly to against a first housing surface portion that diverts the fluid to a second stage of the flow path. The second flow path stage is defined by facing second and third housing surface portions that cause the fluid to flow substantially fully axially in an annular space extending around the central axis between the first stage and a third stage. The fluid flows from the third stage to and through the downstream outlet. A drive is provided for the rotary component.

In one form, the third flow path stage is defined by facing fourth and fifth housing surface portions, and at least one of the fourth and fifth surface portions decreases in radial dimension in a downstream direction.

In one form, the housing defines a fourth flow path stage downstream of the third flow path stage. The fourth flow path stage is bounded by a radially inwardly facing sixth surface portion that has a radius that decreases in a downstream direction over at least a portion of an axial extent of the fourth flow path stage.

In one form, the first housing surface portion increases in diameter in a downstream direction over at least a portion of an axial extent of the first stage.

In one form, the rotary component has a hub with an annular surface that faces radially outwardly and increases in radial dimension over at least a portion of an axial extent of the first stage. The rotary component further has a plurality of blades that project radially outwardly from the annular surface of the hub.

In one form, each of the plurality of blades has the same construction and each has a perimeter edge that has a first length with a radial extent that increases over a portion of an axial extent of the first stage and a second length with a radial extent that decreases over a portion of an axial extent of the first stage.

In one form, the housing has a fixed core component with a parabolically-shaped outer surface opening in an upstream direction that defines the second and fourth surface portions that face radially outwardly.

In one form, the housing has a plurality of vanes in the second fluid flow path stage with adjacent vanes having circumferentially facing surfaces that reside in planes that are parallel to the central axis.

In one form, the core component has a plurality of fixed vanes in the second fluid flow path stage and adjacent vanes have circumferentially facing surfaces that reside in planes that are parallel to the central axis.

In one form, each of the plurality of blades has upstream and downstream ends spaced an axial distance from each other within a first axial length in the first stage and there are no rotary blades on the portable fluid blower other than those that reside within the first axial length of the first stage.

In one form, the fluid flow path has a fourth stage downstream of the third stage and defined by a sixth housing surface portion that decreases in diameter progressively in a downstream direction.

In one form, the housing is substantially hollow over at least a majority of an axial extent of the fourth stage extending from the downstream outlet.

In one form, the portable fluid blower further has an elongate support upon which the housing and drive are supported at spaced locations.

In one form, the elongate support has a central axis and a straight length and the central axis of the housing and the central axis of the support over the straight length of the support are substantially coincident.

In one form, the core component has an open upstream end that is blocked by the rotary component.

In one form, the fixed core component has an outer rib and the housing has a wall with a stepped inside diameter that produces a seat within which the outer rib is seated to confine relative axial movement of the housing and fixed core component.

In one form, the housing has joinable parts between which the fixed core component is captively maintained in an operative position.

In one form, at least one bearing is captively maintained between the housing parts in an operative position and a drive shaft assembly extends through the at least one bearing and connects between the drive and the rotary component.

In one form, the invention is further directed to a portable fluid blower having a housing with a central axis and defining a fluid flow path extending axially between an upstream inlet and a downstream outlet. The fluid flow path is configured to define at least first and second stages through which fluid flows in moving towards the downstream outlet. The first stage is configured to cause incoming fluid to be accelerated in a radial direction and diverted to the second stage. The second stage has a plurality of fixed vanes for guiding fluid flow that have surfaces residing in planes that are substantially parallel to the central axis. The fluid from the second stage is guided to converge toward the central axis through at least one additional stage in moving to and through the downstream outlet. A fan assembly has a rotary component for causing fluid to be moved from the upstream inlet to the downstream outlet. A drive is provided for the rotary component.

In one form, the rotary component has a hub with an annular surface that faces radially outwardly and increases in radial dimension over at least a portion of an axial extent of the first stage. The rotary component further has a plurality of blades that project radially outwardly from the annular surface of the hub.

In one form, each of the plurality of blades has upstream and downstream ends spaced an axial distance from each other within a first axial length in the first stage and there are no rotary blades on the portable fluid blower other than those that reside within the first axial length of the first stage.

DETAILED DESCRIPTION OF THE PREFERRED EMBODIMENT

Figure 1:
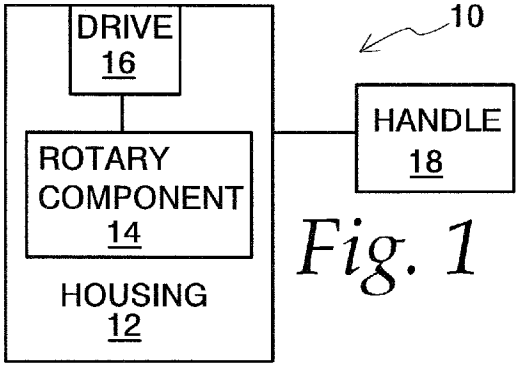
FIG. 1 is a schematic representation of one form of portable fluid blower according to the invention.
Figure 3:
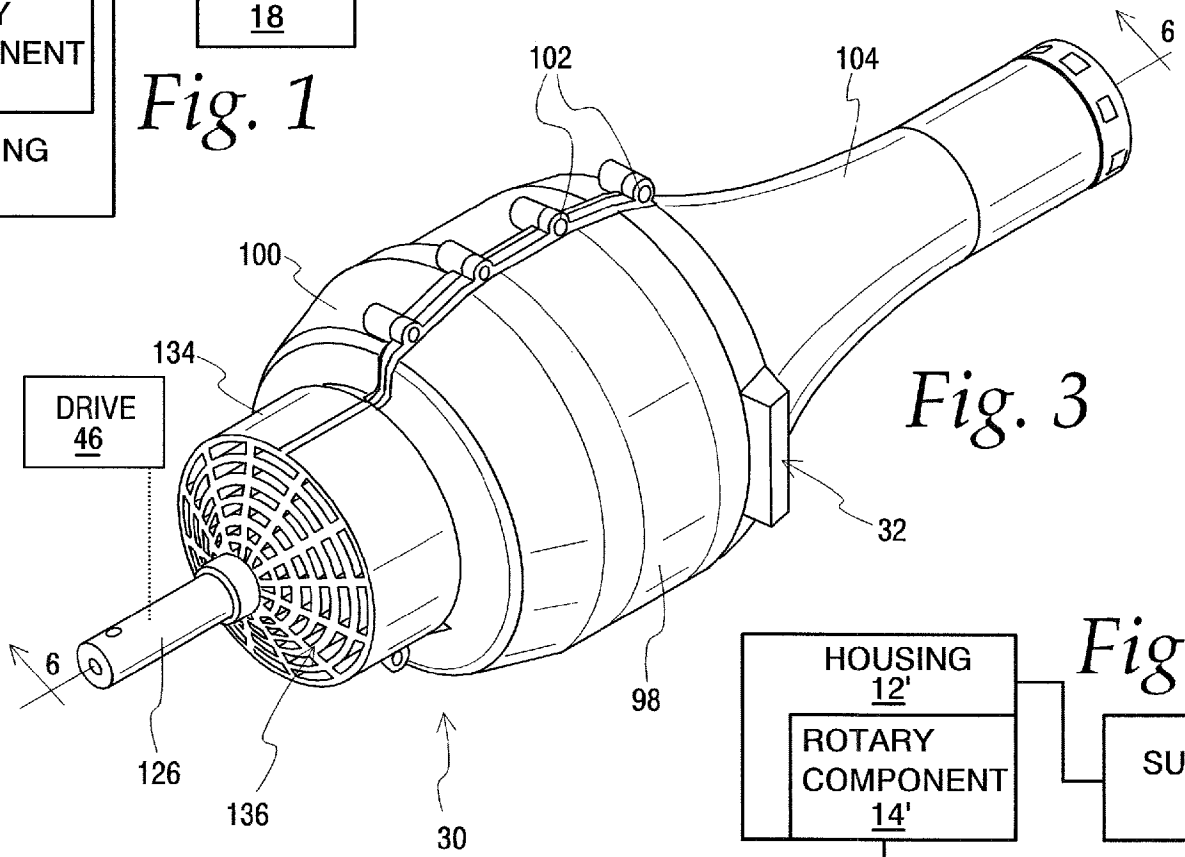
FIG. 3 is a perspective view of one specific form of portable fluid blower, according to the present invention.

In FIG. 1, one form of portable fluid blower, according to the invention, is shown at 10. The blower 10 consists of a housing 12 for a rotary component 14 that is operated by a drive 16 to generate a pressurized fluid supply for discharge at an outlet. A handle 18 is provided upon the housing 12 to allow a user to pick up, transport, and reposition the blower 10 during operation thereof.

Figure 2:
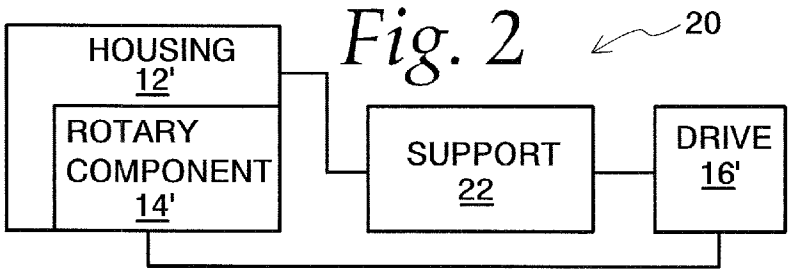
FIG. 2 is a schematic representation of another form of portable fluid blower, according to the invention.
Figure 4:
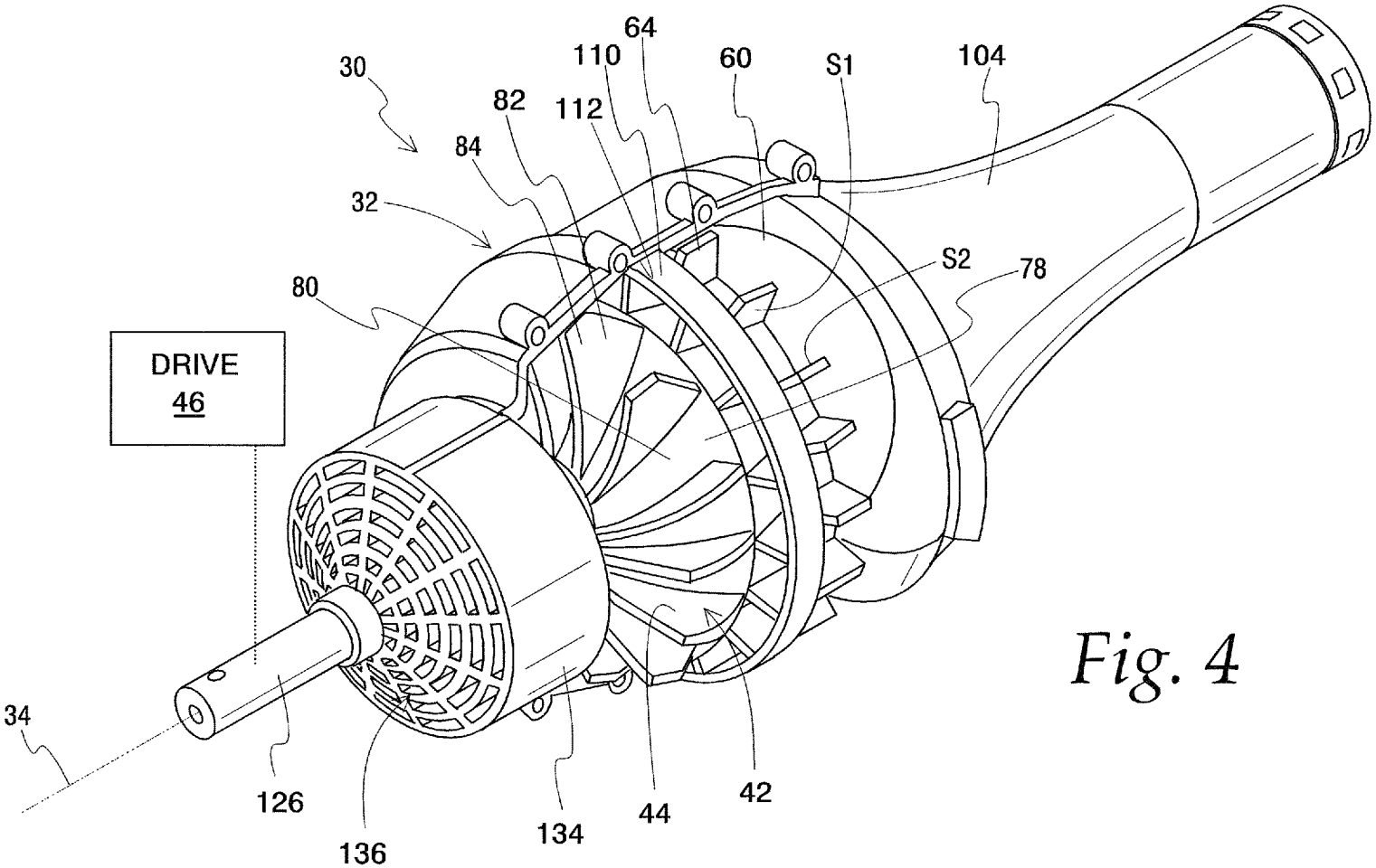
FIG. 4 is a view as in FIG. 3 wherein a housing is broken away to reveal internal components.
Figure 5:
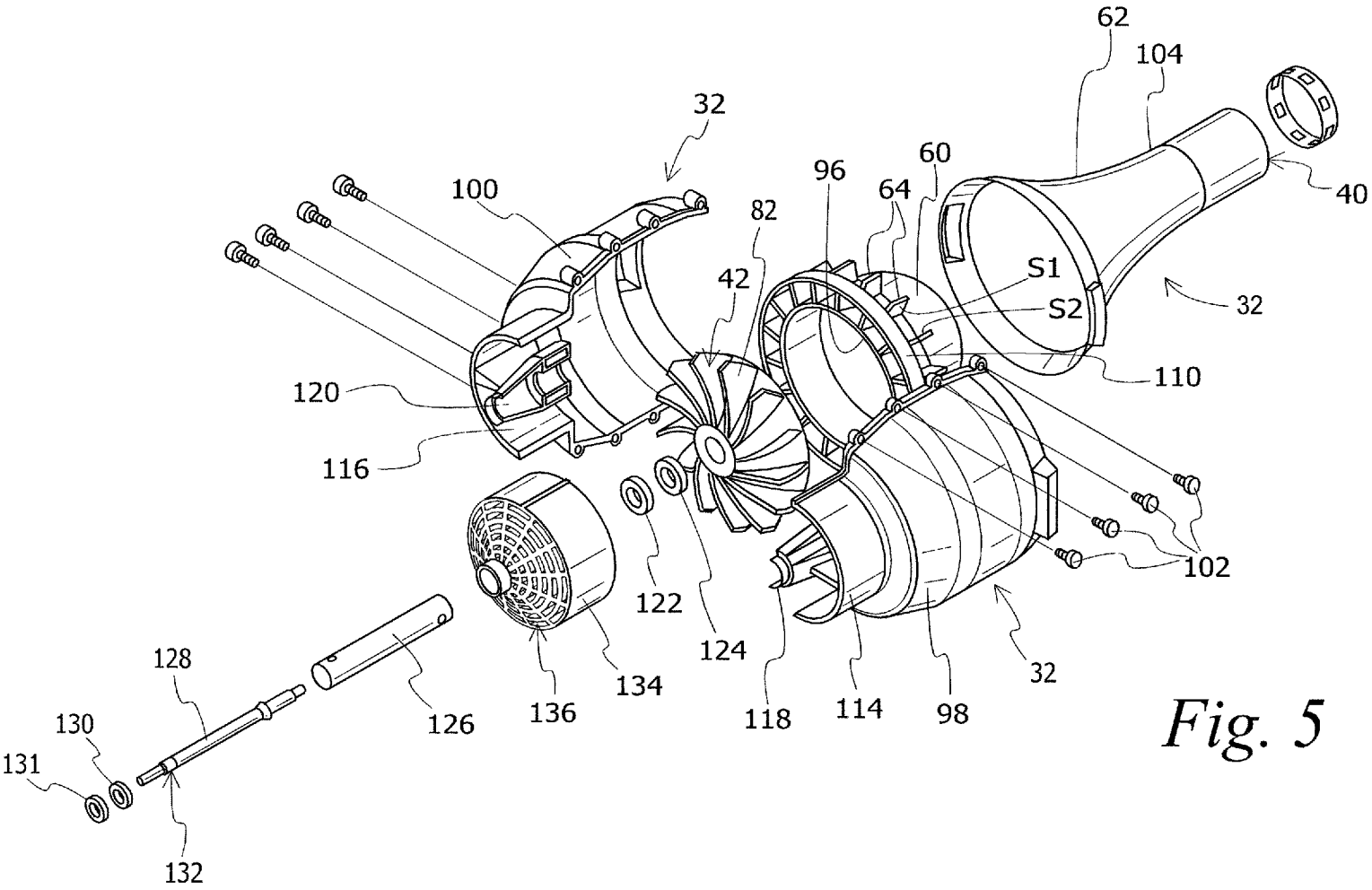
FIG. 5 is a reduced, exploded, perspective view of the blower in FIGS. 3 and 4.

An alternative form of portable fluid blower, according to the present invention, is shown at 20 in FIG. 2. The blower 20 has a support 22 that carries a corresponding housing 12' with a rotary component 14'. A drive 16' is provided on the support 22 at a location spaced from where the housing 12' is carried on the support 22 and operates the rotary component 14'.

The schematic showing of the blowers 10, 20 is intended to encompass the specific designs hereinbelow and others that may incorporate components in different configurations but that function consistently with the inventive concepts disclosed herein.

One specific form of portable fluid blower, according to the present invention, is shown at 30 in FIGS. 3-6. The portable fluid blower 30 has a housing 32 with a central axis 34. The housing 32 defines a fluid flow path 36 extending axially between an upstream inlet 38 and a downstream outlet 40. Incoming air moves through the inlet 38 and to and through the fluid flow path 36, as indicated by the arrows A, to the outlet 40 at which it is discharged under pressure.

A fan assembly at 42 is operable to cause environmental air to be drawn into and moved in the fluid flow path 36 to be discharged at the outlet 40. The fan assembly 42 consists of a rotary component 44 that is operated by a drive 46. A drive shaft assembly 48 connects between the drive 46 and the rotary component 44.

The fluid flow path 36 consists of multiple "stages". In a first fluid flow path stage at 50, fluid incoming at the inlet 38 is accelerated radially outwardly to against a first housing surface portion 52 that diverts the fluid to a second stage of the flow path at 54.

The second flow path stage 54 is defined by facing second and third housing surface portions 56, 58, respectively facing radially outwardly and inwardly to bound an annular space. The second surface portion 56 is defined on a fixed core component 60, with the third surface portion 58 defined on an outer, peripheral housing wall 62.

Figure 6:
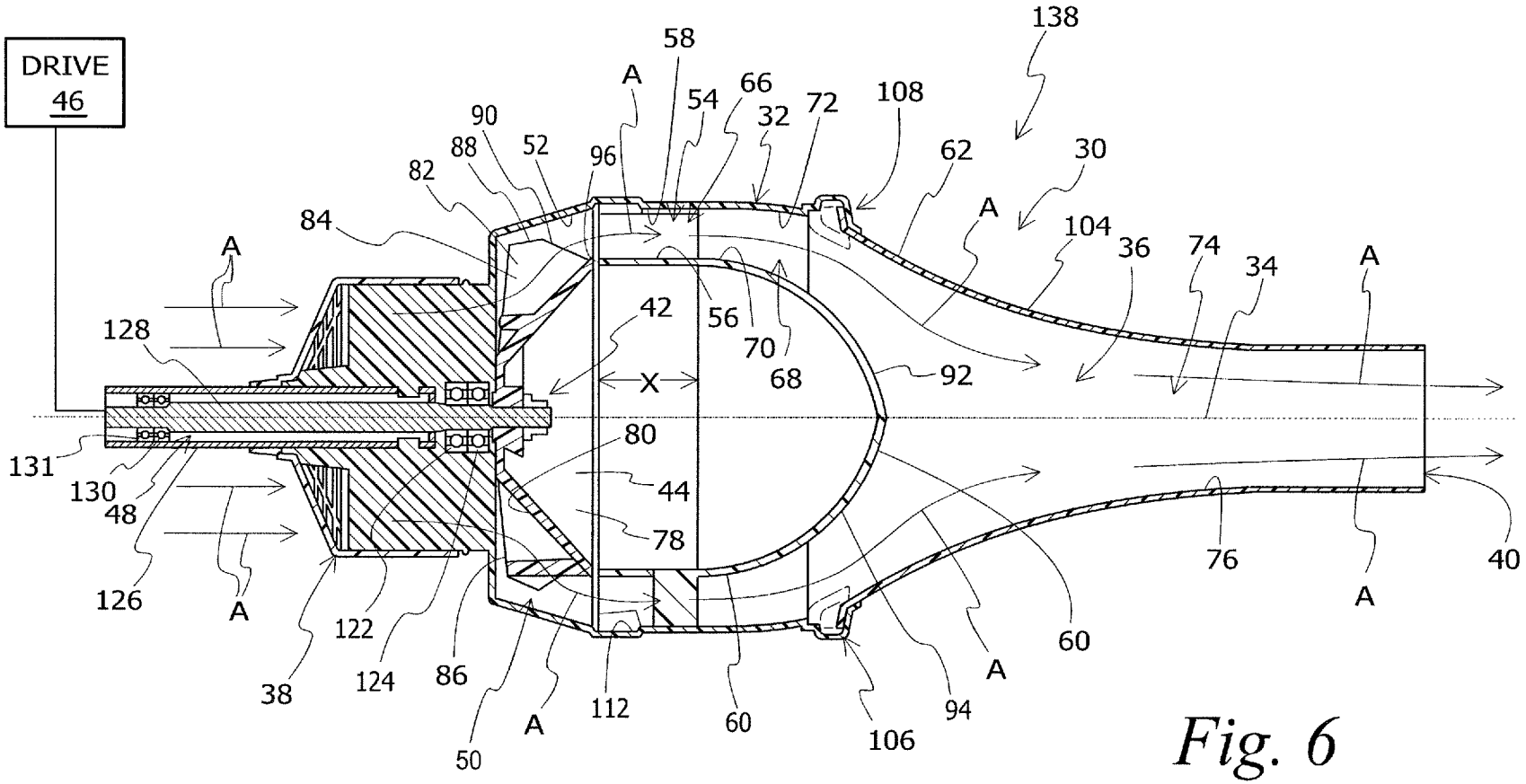
FIG. 6 is a cross-sectional view of the blower taken along line 6-6 of FIG. 3.

Within the second stage 54, fixed vanes 64 project radially at regular intervals to substantially fill the dimension of the gap 66 between the surface portions 56, 58 over the axial extent of the vanes 64, as indicated by the dimension X in FIG. 6.

While not a requirement, the vanes 64 extend substantially orthogonally to the axis 34 at regularly spaced intervals. Adjacent vanes 64 have circumferentially facing surfaces S1, S2 that reside in planes that are parallel to the central axis 34 so that the vanes 64 and surface portions 56, 58 cause fluid to flow substantially fully axially in an annular volume extending around the central axis 34 between the first stage 50 and a third stage 68.

The third stage 68 is defined by facing fourth and fifth surface portions 70, 72, respectively on the core component 60 and wall 62. Over at least a part of the axial extent of the third stage 68, the surface portions 70, 72 both reduce in diameter and have an increased radial spacing moving in a downstream direction.

In this embodiment, the fluid flow path has a fourth stage at 74, downstream of the third stage 68. The fourth stage 74 is bounded by a radially inwardly facing sixth surface portion 76 that has a radius that decreases progressively over at least a portion of an axial extent of the fourth stage 74. In this embodiment, the radius of the surface portion 76 is substantially constant as it approaches the outlet 40 so that the discharging flow pattern is substantially straight and parallel to the central axis 34.

The fourth stage has an axial extent that is greater than the axial extent of each of the first, second, and third stages.

In this embodiment, the rotary component 44 consists of a hub 78 with an annular surface 80 that faces radially outwardly and increases in radial dimension over at least a portion of an axial extent of the first stage 50.

The rotary component 44 has a plurality of blades 82 of identical construction that project radially outwardly from the annular surface 80 of the hub 78 at regular circumferential intervals.

Each of the blades 82 has a body 84 that is curved to open in a circumferential direction. Each body 84 terminates at a perimeter edge 86 with: a) a first length 88 with a radial extent that increases in the downstream direction over a portion of the axial extent of the first stage 50; and b) a second length 90 with a radial extent that decreases over a portion of the axial extent of the first stage 50 in a downstream direction.

The first housing surface portion 52 increases in diameter in a downstream direction over at least a portion of the axial extent of the first stage 50, with the angular orientation of the first surface portion 52 nominally matched to the angular orientation of the perimeter edge length 88 on each blade 82.

The core component 60 has a parabolically-shaped wall 92 that opens axially in an upstream direction. The wall 92 has an exposed, parabolically-shaped outer surface 94 that defines the second and fourth surface portions 56, 70 that face radially outwardly. The open, upstream end 96 of the core component 60 is blocked by the rotary component 44 in a manner whereby the annular surface 80 on the hub 78 of the rotary component 44 blends with the surface portion 56 adjacent to the upstream end of the core component 60.

Incoming fluid/air intercepted by the rotary component 44 is accelerated by the blades 82 in a radial direction so that the fluid impinges on the angled surface portion 52 and thereby is compressed and diverted to the second stage 54. In the second stage 54, the flow path is controlled to align parallel to the axis 34 within the annular volume between the surface portions 56, 58.

Fluid in the third and fourth stages 68, 74 is progressively formed into a confined stream at the outlet 40 that discharges under pressure in a direction substantially parallel to the axis 34 through the area of the outlet 40. All, or substantially all, of the fourth stage 74 is substantially hollow within the surface portion 76 so that fluid movement is substantially unimpeded therein.

In this embodiment, the housing 12 is made with two joinable parts/halves 98, 100 that are contoured to match the rotary component 44 and core 60 and define the aforementioned fluid flow path 36. The housing parts 98, 100 are maintained together through a series of threaded fasteners 102. With the housing parts 98, 100 secured together, the core component 60 is captively maintained in its operative position.

A third housing part 104, that defines a discharge nozzle, is releasably snap fit to the joined housing parts 98, 100 through suitable cooperating connector components at diametrically opposite locations at 106, 108. The nature of these connector components is not critical to the present invention and permanent or different types of releasable connecting structure might be utilized.

In this embodiment, the core component 60 has an outer, annular rib 110 extending around, and connected to, the vanes 64. The wall 62 has a stepped inside diameter that produces a seat at 112 within which the outer rib 110 is seated to confine relative axial movement of the housing 32 and core component 60.

The housing parts 98, 100 respectively have upstream extensions 114, 116 from which shaft support components 118, 120 respectively project in a radially inward direction. With the housing parts 98, 100 fixed together, the extensions 114, 116 cooperatively produce an annular shape. The shaft support components 118, 120, with the housing parts 98, 100 joined, cooperatively captively maintain separate bearings 122, 124 in an operative position and additionally support a sleeve 126. A drive shaft 128 on the drive shaft assembly 48 extends through the sleeve 126 and bearings 122,124 and connects between the drive 46 and rotary component 44 so that as the drive 46 is operated, the rotary component 44 is driven around the axis 34. At least two additional bearings 130, 131 reside within the sleeve 126 and surround the drive shaft 128 to support the upstream end 132 thereof.

While no specific structure is disclosed for connecting to the drive shaft end 132, one skilled in the art would easily devise such a structure that facilitates quick connection and release in the event that the components shown in FIG. 6 would be separated from the drive 46 as for repair, replacement, or substitution by another type of component or operating tool.

A cup-shaped housing 134 is telescoped over the joined extensions 114, 116 and defines a rib pattern at 136 to provide an intake area for fluid introduced to the flow path 36.

Figure 7:
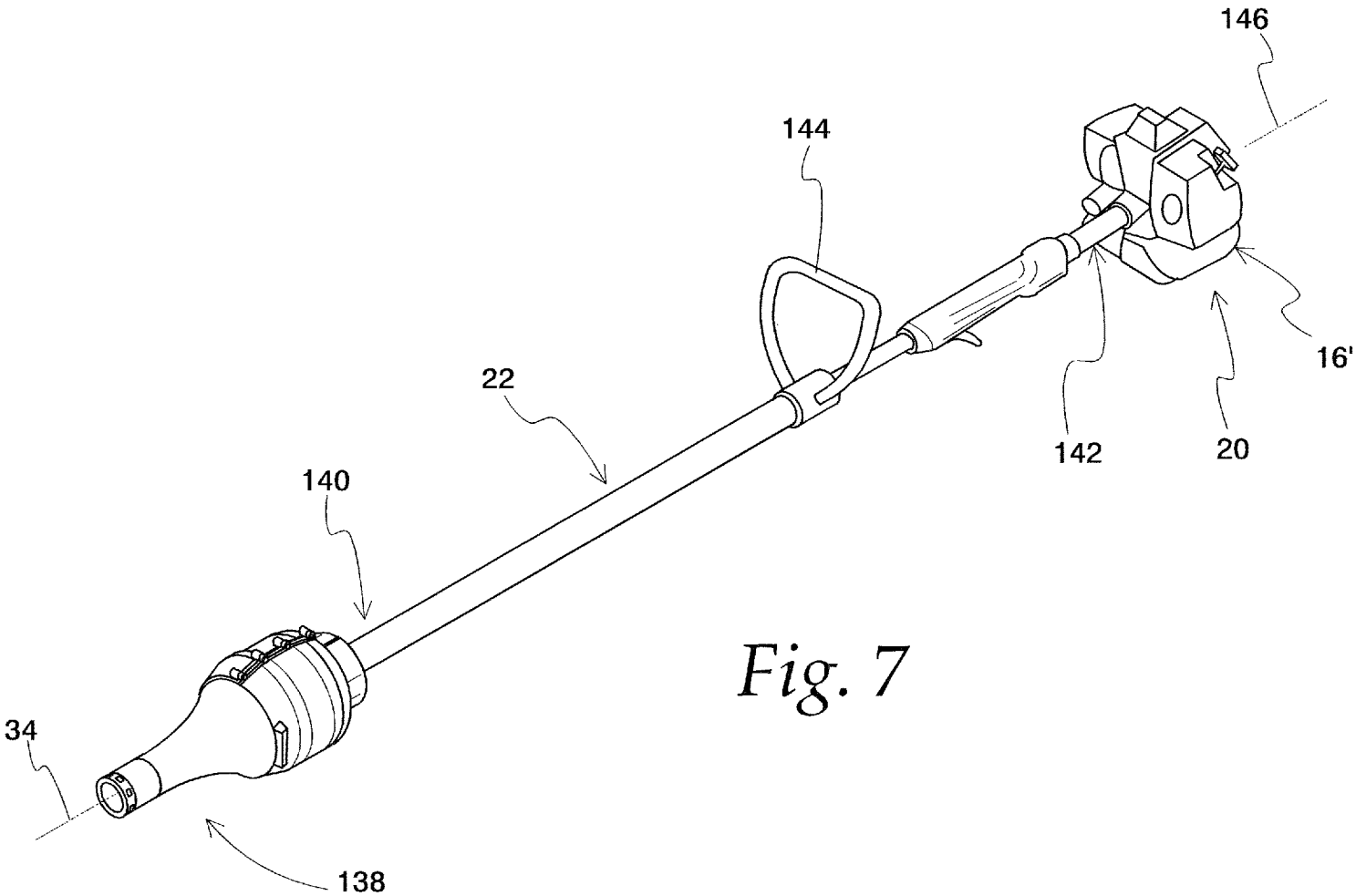
FIG. 7 is a perspective view of one specific form of the inventive blower unit as shown in FIG. 2.

In FIG. 7, a unit at 138, made up of the components between the drive shaft 128 and the outlet 40, is shown attached to a support 22 as typically used for line trimmers, bladed cutters, etc. The support 22 is elongate and substantially straight over its entire extent, though this is not a requirement. The unit 138 is operatively connected to the distal end 140 of the support 22, with the drive 16' at a proximal end 142 of the support 22. A handle 144 is provided on the support 22 to facilitate lifting, transportation, and repositioning of the portable fluid blower 20. The handle 144 is capable of being repositioned relative to the support, as convenient.

In this embodiment, the elongate support has a central axis 146 that is substantially coincident with the central axis 34. As previously noted, this configuration is not required, as the axis 34 might be oriented differently with respect to the support axis 146.

In the embodiments depicted, it is preferred, but not required, that the only rotary blades that are provided on the blowers are those residing in the first stage within the axial dimension between the upstream and downstream ends of the blades 82.

The foregoing disclosure of specific embodiments is intended to be illustrative of the broad concepts comprehended by the invention.

The invention claimed is:

1. A portable fluid blower comprising:

a housing having a central axis and defining a fluid flow path extending axially between an upstream inlet and a downstream outlet;

a fan assembly comprising a rotary component that is operable to draw fluid into a first stage of the flow path and accelerate fluid incoming at the inlet by propelling the drawn fluid in the first stage radially outwardly to against the housing that diverts the fluid to a second stage of the flow path, the first stage bounded by a first housing surface portion that increases in diameter in a downstream direction over at least a portion of an axial extent of the first stage to guide radial outward movement of fluid in the first stage, the second flow path stage defined by facing second and third housing surface portions that cause the fluid from the first stage to be redirected to flow substantially fully axially in an annular space extending around the central axis between the first stage and a third stage, the fluid flowing from the third stage to and through the downstream outlet; and a drive for the rotary component, wherein the portable blower further comprises an elongate support upon which the housing and drive are supported, the elongate support having a length that is substantially parallel to the central axis of the housing.

2. The portable fluid blower according to claim 1 wherein the third flow path stage is defined by facing fourth and fifth housing surface portions, and at least one of the fourth and fifth surface portions decreases in radial dimension in a downstream direction.

3. The portable fluid blower according to claim 2 wherein the housing defines a fourth flow path stage downstream of the third flow path stage, the fourth flow path stage bounded by a radially inwardly facing sixth surface portion that has a radius that decreases in a downstream direction over at least a portion of an axial extent of the fourth flow path stage.

4. The portable fluid blower according to claim 1 wherein fluid propelled in the first stage is propelled radially outwardly to against the first housing surface portion.

5. The portable fluid blower according to claim 4 wherein the rotary component comprises a hub with an annular surface that faces radially outwardly and increases in radial dimension over at least a portion of an axial extent of the first stage, the rotary component further comprising a plurality of blades that project radially outwardly from the annular surface of the hub.

6. The portable fluid blower according to claim 5 wherein each of the plurality of blades has the same construction and each has a perimeter edge that has a first length with a radial extent that increases over a portion of an axial extent of the first stage and a second length with a radial extent that decreases over a portion of an axial extent of the first stage.

7. The portable fluid blower according to claim 6 wherein the housing comprises a fixed core component with a parabolically-shaped outer surface opening in an upstream direction that defines the second and fourth surface portions that face radially outwardly.

8. The portable fluid blower according to claim 1 wherein the housing comprises a plurality of vanes in the second fluid flow path stage with adjacent vanes having circumferentially facing surfaces that reside in planes that are parallel to the central axis.

9. The portable fluid blower according to claim 7 wherein the core component comprises a plurality of fixed vanes in the second fluid flow path stage and adjacent vanes have circumferentially facing surfaces that reside in planes that are parallel to the central axis.

10. The portable fluid blower according to claim 5 wherein each of the plurality of blades has upstream and downstream ends spaced an axial distance from each other within a first axial length in the first stage and there are no rotary blades on the portable fluid blower other than those that reside within the first axial length of the first stage.

11. The portable fluid blower according to claim 1 wherein the fluid flow path comprises a fourth stage downstream of the third stage and defined by a sixth housing surface portion that decreases in diameter progressively in a downstream direction.

12. The portable fluid blower according to claim 11 wherein the housing is substantially hollow over at least a majority of an axial extent of the fourth stage extending from the downstream outlet.

13. The portable fluid blower according to claim 1 wherein the housing and drive are supported at spaced locations on the elongate support.

14. The portable fluid blower according to claim 13 wherein the elongate support has a central axis and a straight length and the central axis of the housing and the central axis of the support over the straight length of the support are substantially coincident.

15. The portable fluid blower according to claim 7 wherein the core component has an open upstream end that is blocked by the rotary component.

16. The portable fluid blower according to claim 7 wherein the fixed core component has an outer rib and the housing has a wall with a stepped inside diameter that produces a seat within which the outer rib is seated to confine relative axial movement of the housing and fixed core component.

17. The portable fluid blower according to claim 16 wherein the housing comprises joinable parts between which the fixed core component is captively maintained in an operative position.

18. The portable fluid blower according to claim 17 further comprising at least one bearing captively maintained between the housing parts in an operative position and a drive shaft assembly extending through the at least one bearing and connecting between the drive and the rotary component.

19. A portable fluid blower comprising:

a housing having a central axis and defining a fluid flow path extending axially between an upstream inlet and a downstream outlet, the fluid flow path configured to define at least first and second stages through which fluid flows in moving towards the downstream outlet, the first stage configured to cause incoming fluid to be accelerated by being propelled in the first stage in a radial direction and diverted to the second stage, the first stage bounded by a first housing surface portion that increases in diameter in a downstream direction over at least a portion of an axial extent of the first stage to guide radial outward movement of fluid in the first stage, fluid from the first stage redirected in the second stage towards an axial flow direction, the second stage having a plurality of fixed vanes for guiding fluid flow that have surfaces residing in planes that are substantially parallel to the central axis, the fluid from the second stage guided to converge toward the central axis through at least one additional stage in moving to and through the downstream outlet;

a fan assembly comprising a rotary component for causing fluid to be moved from the upstream inlet to the downstream outlet;

a drive for the rotary component; and an elongate support with a length, the drive and housing supported at spaced lengthwise locations on the elongate support.

20. The portable fluid blower according to claim 19 wherein the rotary component comprises a hub with an annular surface that faces radially outwardly and increases in radial dimension over at least a portion of an axial extent of the first stage, the rotary component further comprising a plurality of blades that project radially outwardly from the annular surface of the hub.

21. The portable fluid blower according to claim 20 wherein each of the plurality of blades has upstream and downstream ends spaced an axial distance from each other within a first axial length in the first stage and there are no rotary blades on the portable fluid blower other than those that reside within the first axial length of the first stage.

22. The portable fluid blower according to claim 1 wherein a majority of a flow volume of fluid delivered to the downstream outlet is propelled radially outwardly in the first stage.

23. The portable fluid blower according to claim 19 wherein a majority of a flow volume of fluid delivered to the downstream outlet is propelled in the radial direction in the first stage.

24. The portable fluid blower according to claim 3 wherein the radius of the sixth surface is substantially constant as the sixth surface approaches the outlet so that a discharging flow pattern is substantially straight and parallel to the central axis.

25. The portable fluid blower according to claim 3 wherein the fourth stage has an axial extent that is greater than an axial extent of each of the first, second, and third stages.

* * * * *